US010344530B2

(12) United States Patent
Coker et al.

(10) Patent No.: US 10,344,530 B2
(45) Date of Patent: Jul. 9, 2019

(54) MODULAR, LOCKING HEADRAIL-RETENTION MECHANISM

(71) Applicant: GLOBAL CUSTOM COMMERCE, INC., Houston, TX (US)

(72) Inventors: Tuluhan Coker, Istanbul (TR); Daniel H. Cotlar, Houston, TX (US); Berk Coker, Istanbul (TR)

(73) Assignee: GLOBAL CUSTOM COMMERCE INC., Houston, TX (US)

( * ) Notice: Subject to any disclaimer, the term of this patent is extended or adjusted under 35 U.S.C. 154(b) by 120 days.

(21) Appl. No.: 15/216,390

(22) Filed: Jul. 21, 2016

(65) Prior Publication Data

US 2016/0326797 A1 Nov. 10, 2016

Related U.S. Application Data

(62) Division of application No. 13/629,140, filed on Sep. 27, 2012, now Pat. No. 9,410,367.

(51) Int. Cl.
*E06B 9/323* (2006.01)

(52) U.S. Cl.
CPC ..... *E06B 9/323* (2013.01); *Y10T 403/60* (2015.01)

(58) Field of Classification Search
CPC ..... E06B 9/323; E06B 9/17; E06B 9/17007; E06B 9/322; E06B 9/38; A47H 1/022; A47H 1/02; A47H 1/08; A47H 1/12; A47H 1/10; A47H 1/14; B43K 24/084; Y10T 403/32483; F16B 7/10
See application file for complete search history.

(56) References Cited

U.S. PATENT DOCUMENTS 527,273 A * 10/1894 Fowler et al. ..... A47H 1/022 211/105.6
1,232,729 A 7/1917 Starn
3,952,877 A 4/1976 Kindl
4,809,401 A 3/1989 Honig
(Continued)

OTHER PUBLICATIONS

Office Action Received in Canadian Counterpart Application 2,919,518 dated Oct. 7, 2016 (3 pages).
(Continued)

*Primary Examiner* — Katherine W Mitchell
*Assistant Examiner* — Jeremy C Ramsey
(74) *Attorney, Agent, or Firm* — Greenberg Traurig, LLP

(57) ABSTRACT

In accordance with the present disclosure, a system and method for Modular, Locking Headrail-Retention Mechanism is described. The module, locking headrail-retention mechanism may, in certain embodiments be separate from a headrail, and insertable into at least one end of the headrail. In other embodiment, the locking headrail-retention mechanism may be manufactured as part of the headrail. The locking headrail-retention mechanism may comprise a cylindrical housing and a first cam disposed within the cylindrical housing. The locking headrail-retention mechanism may also include a retention plate proximate one end of the cylindrical housing and axially aligned with the first cam. A biasing member may be disposed within the cylindrical housing, and may impart an axial force on the first cam. The first cam may be operable to selectively prevent the axial force from being imparted on the retention plate.

26 Claims, 4 Drawing Sheets

(56) References Cited

U.S. PATENT DOCUMENTS

| | | | | |
|---|---|---|---|---|
| 4,848,432 | A | 7/1989 | Connolly | |
| 7,549,615 | B2 | 6/2009 | Shevick | |
| 8,408,486 | B2 * | 4/2013 | Di Stefano | E06B 9/42 242/407 |
| 8,479,932 | B2 | 7/2013 | Carney | |
| 8,505,129 | B2 | 8/2013 | Parker et al. | |
| 8,596,594 | B2 | 12/2013 | Shevick | |
| 2008/0011922 | A1 * | 1/2008 | Shevick | E06B 9/266 248/254 |
| 2008/0245486 | A1 | 10/2008 | Brown | |
| 2010/0003062 | A1 | 1/2010 | Tamano et al. | |
| 2010/0276090 | A1 * | 11/2010 | Zagone | E04G 21/30 160/368.1 |
| 2011/0031198 | A1 | 2/2011 | Trettin et al. | |
| 2013/0084130 | A1 | 4/2013 | McClure | |

OTHER PUBLICATIONS

Canadian office action received in related patent application No. 2,919,514, dated Feb. 2, 2017, three pages.

* cited by examiner

MODULAR, LOCKING HEADRAIL-RETENTION MECHANISM

CLAIM OF PRIORITY UNDER 35 U.S.C. § 120

The present Application for Patent is a divisional of patent application Ser. No. 13/629,140 entitled "SYSTEM AND METHOD FOR A MODULAR, LOCKING HEADRAIL-RETENTION MECHANISM" filed Sep. 27, 2012, pending, and assigned to the assignee hereof and hereby expressly incorporated by reference herein.

TECHNICAL FIELD

The present disclosure relates generally to the operation of computer systems and information handling systems, and, more particularly, to a System and Method for a Modular, Locking Headrail-Retention Mechanism.

BACKGROUND

Window coverings, including blinds and shades, are ubiquitous in homes and businesses. Typical blinds and shades require installation with brackets affixed to the wall. Installation can be an involved process, with numerous steps, tools, and measurements to account for, which can be intimidating for some homeowners. Additionally, it may require tools or expertise that the homeowners do not have, leading many to rely on professionals for installation. This can be inconvenient and expensive. What is needed is a way for homeowners to install window coverings themselves, without requiring multiple tools or any particular expertise in hanging window coverings.

SUMMARY

In accordance with the present disclosure, a system and method for Modular, Locking Headrail-Retention Mechanism is described. The module, locking headrail-retention mechanism may, in certain embodiments be separate from a headrail, and insertable into at least one end of the headrail. In other embodiment, the locking headrail-retention mechanism may be manufactured as part of the headrail. The locking headrail-retention mechanism may comprise a cylindrical housing and a first cam disposed within the cylindrical housing. The locking headrail-retention mechanism may also include a retention plate proximate one end of the cylindrical housing and axially aligned with the first cam. A biasing member may be disposed within the cylindrical housing, and may impart an axial force on the first cam. The first cam may be operable to selectively prevent the axial force from being imparted on the retention plate.

In accordance with certain embodiments, a method for positioning and maintaining a headrail in a compression fit engagement is disclosed. The method may comprise locking a biasing member into a compressed position. The biasing member may be positioned inside of a headrail when locked or may be located outside of the headrail when locked and then inserted into the headrail. The method may further include positioning an end of the headrail proximate to an engagement surface, and unlocking the biasing member. Unlocking the biasing member may cause the end of the headrail to form a compression fit engagement with the engagement surface.

The present disclosure allows for certain advantages over typical headrail hanging mechanisms. First, instead of an installation process requiring multiple tools and fixed brackets that are screwed into the wall, the locking headrail-retention mechanism described herein allows for a tool-less installation that can be completed by a "do-it-yourself" homeowner without extensive experience in hanging window coverings. Additionally, the modular, locking headrail-retention mechanism may be manufactured separately from the headrail, and interchangeable with headrails of various sizes. Other technical advantages will be apparent to those of ordinary skill in the art in view of the following specification, claims, and drawings.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

While embodiments of this disclosure have been depicted and described by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to the operation of computer systems and information handling systems, and, more particularly, to a System and Method for a Modular, Locking Headrail-Retention Mechanism Illustrative embodiments of the present invention are described in detail below. In the interest of clarity, not all features of an actual implementation are described in this specification. It will of course be appreciated that in the development of any such actual embodiment, numerous implementation specific decisions must be made to achieve the developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure.

Figure 1:
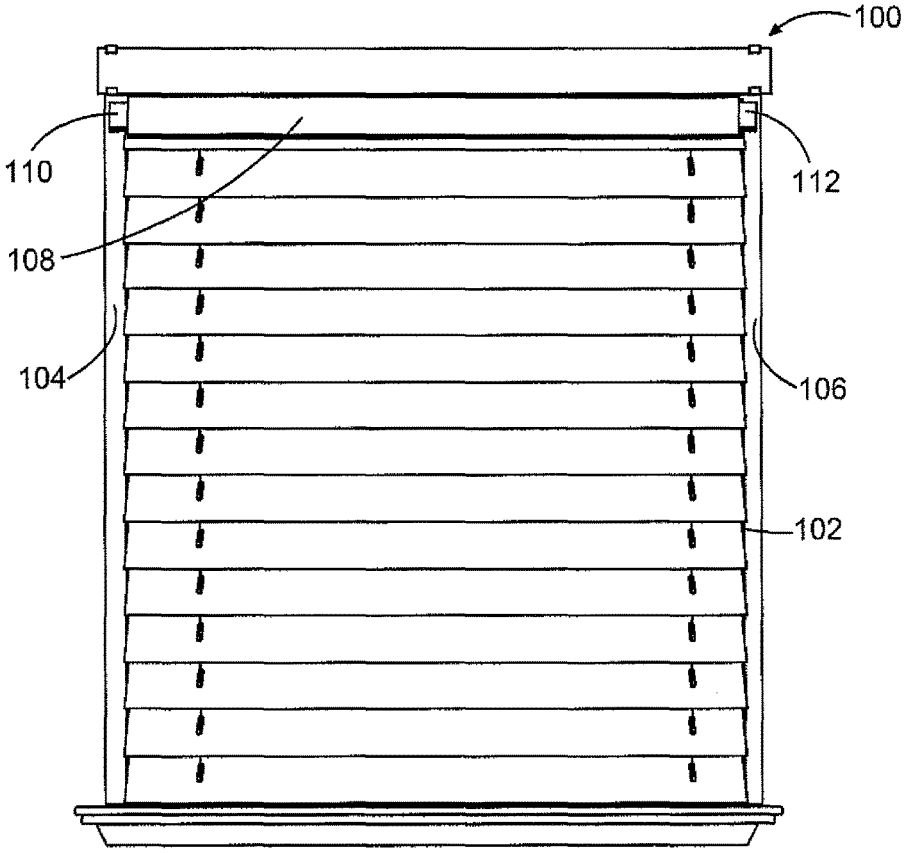
FIG. 1 shows an example headrail with a modular, locking headrail-retention mechanism, according to aspects of the present disclosure.

Shown in FIG. 1 is an example window covering 100 comprising a headrail 108 with modular, locking headrail-retention mechanisms 110 and 112 positioned on either end. As can be seen, the headrail 108 may support shade 102, which may be raised and lowered using mechanisms coupled to the headrail 108. In certain embodiments, as will be described below, the modular, locking headrail-retention mechanisms 110 and 112 may include a generally cylindrical portion that is sized to be installed into a cylindrical opening at either end of the headrail 108. The modular aspect of the mechanisms 110 and 112 may allow the headrail 108 to be easily interchanged, and manufactured inexpensively. In other certain embodiments, the modular, locking headrail-retention mechanisms 110 and 112 may be manufactured within the headrail 108, instead of being installed separately. Likewise, mechanical components of the modular, locking headrail-retention mechanisms 110 and 112 may be positioned at an internal portion of the headrail 108, rather than at the ends.

As can be seen, the modular, locking headrail-retention mechanisms 110 and 112 may be in a compression fit/friction engagement with engagement surfaces 104 and 106. In the embodiment shown, the engagement surfaces 104 and 106 may be window sills for a window 102. Although the embodiment shown in FIG. 1 may be a common use, the functionality of the modular, locking headrail-retention mechanisms described below may be used in other headrail hanging configurations, as would be appreciated by one of ordinary skill in view of this disclosure.

Additionally, the locking headrail-retention mechanisms 110 and 112 may be designed to reduce the amount of light, or the "light gap", around the shade 102. Traditional installations with fixed brackets can be designed such that the shade 102 substantially fills the window, leaving little room around the shade 102 for light to pass. In certain embodiments, the locking headrail-retention mechanisms 110 and 112 may be thicker than the traditional brackets, leading to the "light gap." In certain embodiments, however, the "light gap" may be minimized by using a low profile body and a strong, highly compressible biasing member.

Figure 2:
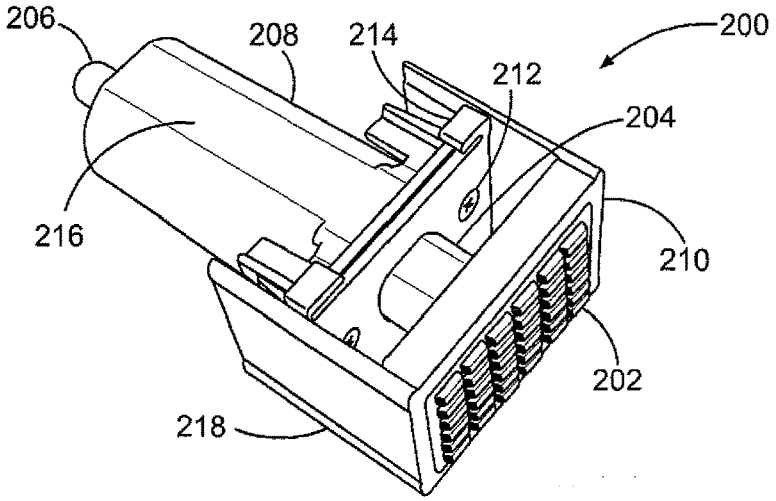
FIG. 2 shows an isometric view of an example modular, locking headrail-retention mechanism, according to aspects of the present disclosure.

FIG. 2 shows an isometric view of an example modular, locking headrail-retention mechanism 200, according to aspects of the present disclosure. The mechanism 200 includes a generally cylindrical housing 208, which may contain a biasing member, as will be described below. In certain embodiments, the generally cylindrical housing 208 may include at least one flat portion 216 that may facilitate insertion and removal of the mechanism 200. The housing 208 may be partially closed at one end by a retaining cap 214, which may be coupled to the housing 208 via screws 212. As will also be described below, the retaining cap 214 may retain the biasing member and other mechanical features of the mechanism 200 within the housing 208. A piston 206 may protrude through an opening in the top of the housing 208 and may be directly or indirectly engaged with the retention plate 210. In certain embodiments, as the retention plate 210 travels toward the housing 208, the piston 206 may extend further beyond the housing 208 to accommodate the axial movement of the retention plate 210. In the embodiment shown, the retention plate 210 may be coupled to the bottom portion of a cam 204 that protrudes through an opening in the retaining cap 214, on a side of the housing 208 opposite the piston 206. The second cam 204 may be indirectly engaged with the piston 206. And the piston 206 may move within the housing 208 to accommodate the axial movement of the cam 204 within the housing 208.

In certain embodiments, the retention plate 210 may include stabilizers 218 to prevent the retention plate 210 from rotating and torquing relative to the housing 208. In certain embodiments, the retention plate 210 may also include a grip surface 202. The grip surface 202 may comprise a rubber or plastic insert that is inset within the retention plate 210. As can be seen, the grip surface 202 may comprise a plurality of protuberances 202 *a*, which extend beyond the grip surface 202. As will be appreciated by one of ordinary skill in the art in view of this disclosure, the plurality of protuberances 202 *a* may be deformable and compressible, such that when then contact an engagement surface, they compress and increase the friction between the modular, locking headrail-retention mechanism 200 and an engagement surface. In certain embodiments, the grip surface 202 may not be affixed to the engagement surface, such as by adhesive, and may be removable and reusable as needed.

Figure 3:
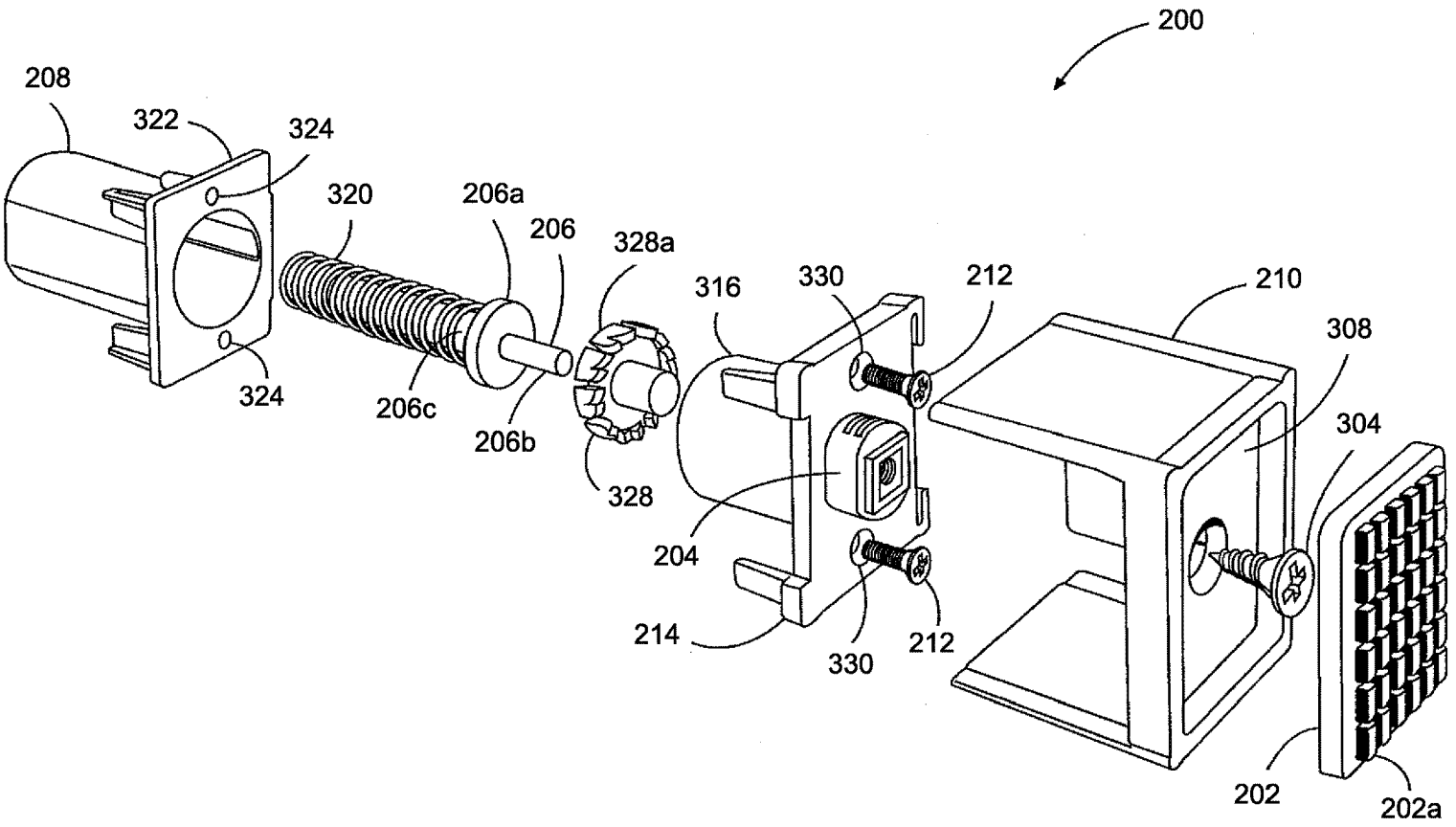
FIG. 3 shows an expanded view of an example modular, locking headrail-retention mechanism, according to aspects of the present disclosure.

FIG. 3 shows an expanded, mechanical view of an example modular, locking headrail-retention mechanism 200, according to aspects of the present disclosure. The mechanism 200 may include a generally cylindrical housing 208 with a connection plate 322 disposed at one end. When the mechanism 200 is assembled, a biasing member 320, piston 206, and first cam 328 may be disposed within the housing 208. Connection plate 322 may be used to couple the housing 208 to a retaining cap 214, thereby retaining the biasing member 320 and first cam 328 within the housing 208. In certain embodiments, the connection plate 322 may comprise screw holes 324 which may align with screw holes 330 on retaining cap 214. Screws 212 may couple the retaining cap 214 to the connection plate 322 on the housing 208. The retaining cap 214 may, for example, impart a static axial force on the biasing member 320 when coupled to the housing 208.

In certain embodiments, a sleeve 316 may be coupled to one side of the retaining cap 214. The sleeve 316 may be generally cylindrical and may be sized to fit inside of the housing 208 when the housing 208 and the retaining cap 214 are coupled together. When the mechanism 200 is assembled, the first cam 328 may be positioned within the sleeve 316 and may engage with piston 206. As can be seen, piston 206 may include a shoulder 206 *a* that engages with biasing member 320, a first portion 206 *b* that engages with the first cam 328 and a second portion 206 *c* around which the biasing member 320 is at least partially disposed. When the mechanism 200 is assembled, the biasing member 320 may contact a top portion of the housing 208 and impart an axial force on the first cam 328 via the shoulder 206 *a* and the first portion 206 *a* of the piston 206.

In certain embodiment, first cam 328 may be operable to selectively prevent the axial force from being imparted to retention plate 210, as will be described below. For example, in certain embodiments, the first cam 328 may engage with a second cam 204 within the sleeve 316. The first cam 328 may comprise a first cam interface 328 *a* that may engage with a second cam interface (not shown) on the cam 204. When the mechanism 200 is assembled, a retention plate 210 may be positioned proximate one end of the housing 208, axially aligned with the first cam 328, and coupled to a portion of the second cam 204 that protrudes through the retaining cap 214, using screw 304. Movement by the retention plate 210 toward the housing 208 may be accompanied by a corresponding axial movement by the second cam 204 toward the top of the housing 208, which may impart an axial force on the first cam 328 and compress the biasing member 320. Movement by the retention plate 210 toward the housing 208 may also cause the second cam 204 to impart a rotational force on the cam 328 using a second cam interface, as will be described below. The first cam interface 328 *a* may be operable to engage with an alignment member (not shown) disposed within the housing 208, such as on an interior surface of the sleeve 316, to lock the biasing member 320 into a compressed position. Once the first cam 328 locks the biasing member 320 into the compressed position, the axial force of the biasing member 320 may not be imparted on the retention plate 210. Subsequent movement of the retention plate 210 toward the top of the housing 208 may unlock the first cam 328 and biasing member 320, allowing the axial force generated by the biasing member 320 to be transmitted to the retention plate 210.

As can be seen, the retention plate 210 may further comprise a grip surface 202, which may be defined by an insert 202 *a* installed within an inset portion 308 of the retention plate 210. The insert 202 *a* may be manufactured from rubber or plastic, and may include a surface 202 that protrudes beyond the surrounding surface of the retention plate 210. The surface 202 may comprise a plurality of protuberances each with similar size and shape. Like the insert 202 *a*, the protuberances may be manufactured of plastic or rubber, and may deform when they contact an engagement surface. The deformation of the protuberances may increase the contact surface area between the retention plate and the engagement surface, thereby increasing the friction force between the retention plate and the engagement surface. The increased friction force may lead to a headrail that can withstand a greater weight without slippage.

Figure 4A:
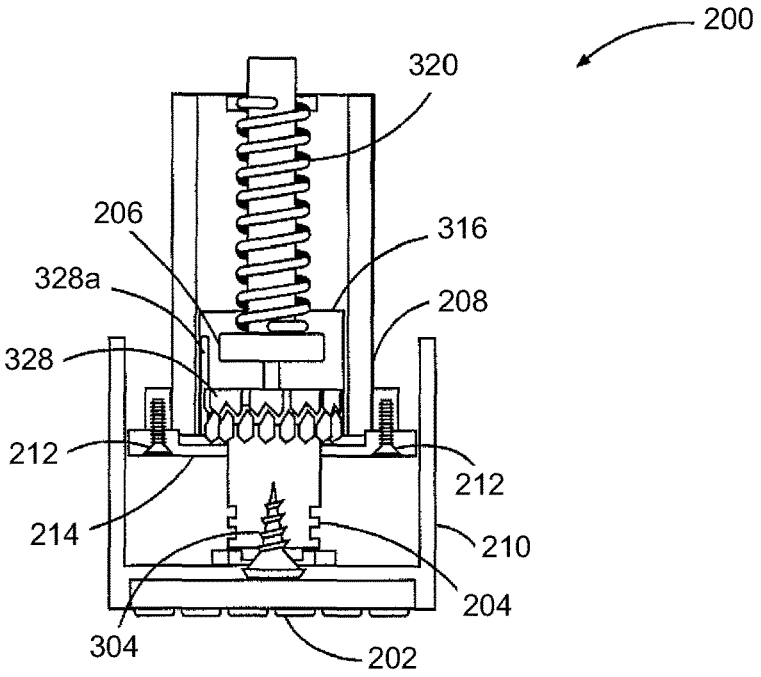
FIG. 4*a* shows a cross section of an example modular, locking headrail-retention mechanism with the biasing member unlocked, according to aspects of the present disclosure.
Figure 4B:
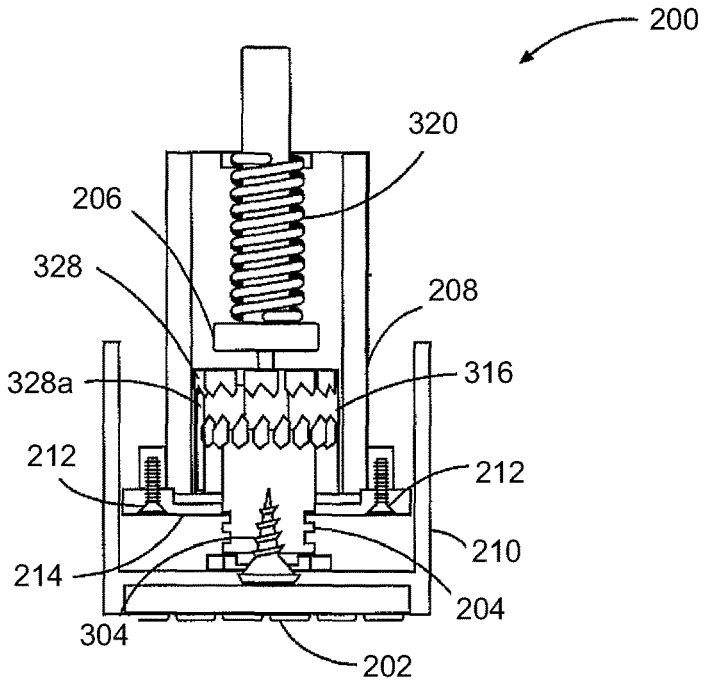
FIG. 4*b* shows a cross section of an example modular, locking headrail-retention mechanism with the biasing member locked in a compressed state, according to aspects of the present disclosure.
Figure 5A:
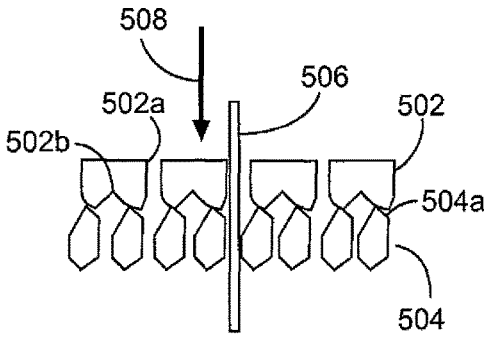
FIGS. 5*a-d* show the functionality of an example cam mechanism, according to aspects of the present disclosure.
Figure 5B:
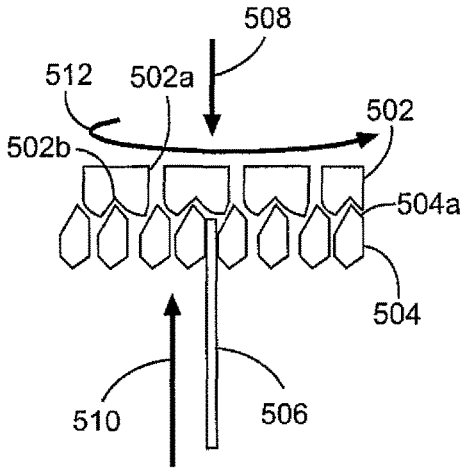
Figure 5C:
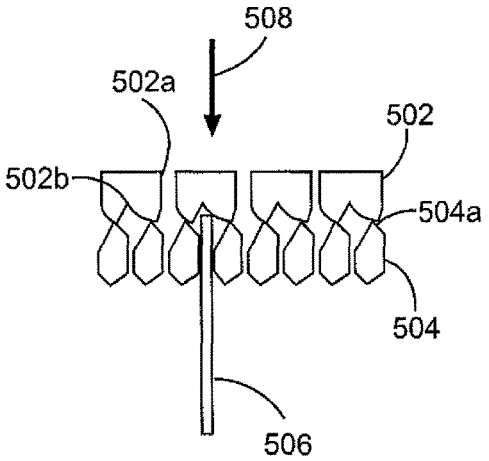
Figure 5D:
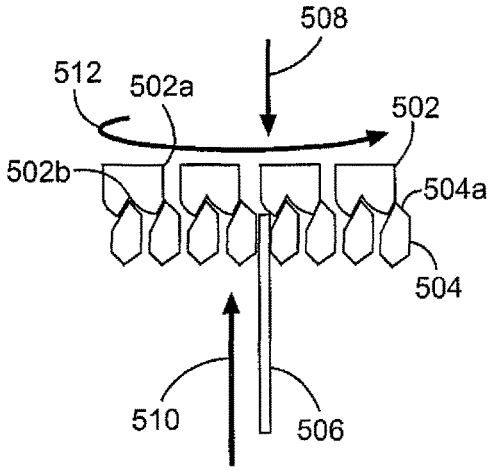

FIGS. 4 *a* and 4 *b* show a cross section of an example assembled modular, locking headrail-retention mechanism 200, with the biasing member 320 locked in a compressed position in FIG. 4 *b* and unlocked in FIG. 4 *a*. As can be seen, the mechanism 200 may include a generally cylindrical housing 208, with a first cam 328, a biasing member 320, a piston 206 and a second cam 204 at least partially disposed therein. The biasing member 320 may be at least partially disposed around the piston 206, imparting an axial force on a top surface of the housing 208 and on a shoulder of the piston 206. A bottom portion of the piston 206 may engage the first cam 328, imparting the axial force on the first cam 328. In FIG. 4 *a*, when the biasing member 320 is unlocked, the first cam 328 may be engaged with and impart the axial force on the retention plate 210 through the second cam 204, to which the retention plate 210 may be coupled by a screw 304.

The piston 206, biasing member 320, first cam 328, and second cam 204 may be held within the housing 208 by a retaining cap 214, which may be coupled to the housing 208 by screws 212. In addition to holding the elements within the housing 208, the retaining cap may limit the axial movement of the first cam 328 and the second cam 204 in at least one direction. For example, when the biasing member 320 is unlocked, as in FIG. 4 *a*, the first cam 328 may impart the axial force from the biasing member 320 onto the second cam 204/retention plate 210, urging the second cam 204/retention plate 210 away from the housing 208. In the embodiment shown, the retaining cap 214 may limit the axial distance the retention plate 210 can travel, by contacting a shoulder on the second cam 204.

The retaining cap 214 may also comprise a sleeve 316 that is at least partially disposed within the housing 208. As can be seen, both the first cam 328 and the second cam 204 may be at least partially disposed within the sleeve 316. The sleeve 316 may include at least one integral alignment member 316 *a* on an inner surface, which may be used in conjunction with the first cam 328 to selectively prevent the axial force generated by the biasing member 320 from being imparted on the retention plate 210. For example, as can be seen in FIGS. 4 *a* and 4 *b* and as will be described in greater detail below, the first cam 328 may include a first cam interface 328 *a* with a plurality of grooves spaced radially around a circumference of the cam. In an unlocked state, the grooves in the first cam interface 328 *a* may align with the alignment member 316 *a*, allowing the first cam 328 to move axially within the housing 208 and sleeve 316. By moving freely within the sleeve 316, the first cam 328 is free to impart the axial force from the biasing member 320 onto the second cam 204/retention plate 210. In contrast, when the biasing member 320 is locked in a compressed state, as shown in FIG. 4 *b*, the first cam interface 328 *a* may engage with a top surface of the alignment member 316 *a*, preventing first cam 328 from moving axially away from the top of the housing 208 beyond the top of the alignment member 316 *a*, and also preventing first cam 328 from imparting the axial force to the second cam 204/retention plate 210. As will be described below and appreciated by one of ordinary skill in the art in view of this disclosure, the first cam 328 may be toggled between the unlocked and locked configuration and operable to selectively prevent the axial force of the biasing member 320 from being imparted on retention plate 210.

In certain embodiments, when the biasing member 320 is locked in the compressed state, the second cam 204 and retention plate 210 may move axially relative to the first cam 328, confined by the first cam 328 and retaining cap 214. In such a configuration, the axial force of the biasing member 320 is being imparted on the sleeve 316, and not the second cam 204/retention plate 210. When toggled to an unlocked state, the first cam 328 may engage with the second cam 204, imparting the axial force of the biasing member 320 to the retention plate 210. If the retention plate 210 is positioned proximate an engagement surface, the friction engagement surface 104, which may include a plurality of protuberances, will engage the engagement surface based, at least in part, on the axial force of the biasing member 320.

FIGS. 5 *a-d* show one example embodiment of a first cam that is operable to selectively prevent an axial force from being imparted on a retention plate. As will be described below, the first cam may be operable to selectively prevent a first axial force from being imparted on a retention plate based at least in part, on a second axial force, opposite the first axial force, imparted on the first cam. In particular, FIGS. 5 *a-d* show an example progression between a locked state and an unlocked state of a biasing force using a first cam, a second cam, and an alignment member similar to those described above with respect to mechanism 200 in FIGS. 4 *a* and 4 *b*. FIG. 5 *a* shows the first cam interface 502 in an unlocked position, with the alignment member 506 positioned within one of the grooves 502 *a* positioned radially around the first cam interface 502. The first can interface 502 may move axially along the alignment member 506, urged downward by the axial force of a biasing member (not shown) as indicated by arrow 508. The first cam interface 502 may engage with the second cam interface 504, imparting the axial force 508 to the second cam interface 504, which may transmit the force to a retention plate similar to retention plate 210 in FIGS. 4 *a* and 4 *b*.

As can be seen in FIG. 5 *a*, the first cam interface 502 *a* may contact the second cam interface 504 at a plurality of sloped segments 504 *a* of the second cam interface 504. The sloped segments 504 *a* of the second cam interface 504 may impart a clockwise rotational force on the first cam interface 502 when an axial force opposite the axial force 508 is applied to the second cam interface 504 *a*. FIG. 5 *b* illustrates the rotational force as line 512 and the opposite axial force as line 510. When the alignment member 506 is positioned within grooves 502 *a* of the first cam interface 502, the first cam interface 502 may be prevented from rotating according to the rotational force 512. When the first cam interface 502 moves axially past a top end of the alignment member 506, which may occur, for example, when the retention plate in FIGS. 4 *a* and 4 *b* is compressed toward the cylindrical body, the first cam interface 502 may rotate until a pointed end of the second cam interface 504 contacts a recess 502 *b* of the first cam interface 502. Once the opposite axial force 510 is removed, such as when the retention plate in FIGS. 4 *a* and 4 *b* is released, the axial force 508 may push the first cam interface 502 toward the alignment member 506. A top surface of the alignment member 506 may contact a recess 502 *b* of the first cam interface 502, which may prevent further downward axial movement. This configuration is shown in FIG. 5 *c*, where the first cam interface 502 prevents the axial force 508 from being imparted on second cam interface 504. If the first cam interface 502 is again urged past a top end of the alignment member 506, the second cam interface 504 may impart a rotational force 512 of the first cam interface 502, causing the pointed end of the second cam interface 504 to contact recess 502 *b*. Once the opposite axial force 510 is removed, a groove 502 *a* may be aligned with the alignment member 506, unlocking the mechanism, and allowing the first cam interface 502 to impart axial force 508 on the second cam interface 504, such as in FIG. 5 *a*. Through this toggling, the first cam interface 502 may be operable to selectively prevent an axial force from being imparted on a retention plate connected to the second cam. Above is but one configuration for selectively preventing the axial force from being transmitted; other configurations are possible as would be appreciated by one of ordinary skill in view of this disclosure. Additionally, although the mechanisms described in FIGS. 5 *a-d* may be incorporated into a modular, locking headrail-retention mechanism similar to those shown in FIGS. 4 *a* and 4 *b*, the mechanisms described in FIGS. 5 *a-d* may also be implemented directly within a headrail mechanism.

Additionally, a method for positioning and maintaining a headrail in a pre-determined position may incorporate aspects of the present disclosure. The method may include locking a biasing member into a compressed position. The biasing member may be located within a locking, headrail-retention mechanism which may be inserted into an end of the headrail before or after the biasing member is locked. In other embodiments, the biasing member may be manufactured as part of the headrail.

Locking the biasing member into a compressed position may comprise causing a first cam to engage with an alignment member disposed within the headrail. This may be accomplished, for example, by compressing an end of the headrail in an unlocked state until a first cam passes a top surface of an alignment member and then releasing the end of the headrail, as described above. The method may further comprise positioning an end of the headrail proximate to an engagement surface. The engagement surface may comprise, for example, a window sill as described above, or some other engagement surface.

The biasing member may then be unlocked, causing the end of the headrail to form a compression engagement with the engagement surface. Unlocking the biasing member may comprise causing the first cam to disengage with the alignment member. This may be accomplished, for example, by compressing an end of the headrail in a locked state until the first cam passes a top surface of an alignment member and then releasing the end of the headrail, as described above. The biasing member may impart a first axial force on the first cam, and causing the first cam to disengage with the alignment member may comprise imparting a second axial force, opposite the first axial force, on the first cam. Imparting a second axial force on the first cam may comprise using a second cam to impart the second axial force on the first cam, where the second cam also imparts a rotational force on the first cam, as described above. In certain embodiments, once the biasing member is unlocked, most or all of the axial force of the biasing member may urge the end of the headrail toward the engagement surface.

In certain embodiments, the end of the headrail may comprise a retention plate comprising a grip surface with a plurality of protuberances The protuberances may, for example, be manufactured from a plastic or rubber that deform when they contact an engagement surface. The deformation of the protuberances may increase the contact surface area between the retention plate and the engagement surface, thereby increasing the friction force between the retention plate and the engagement surface.

Although the present disclosure has been described in detail, it should be understood that various changes, substitutions, and alterations can be made hereto without departing from the spirit and the scope of the invention as defined by the appended claims.

What is claimed is:

1. A method for positioning and maintaining a headrail in a predetermined position, the headrail comprising a main body, a biasing member and a retention plate configured to move in an axial direction relative to the main body, the method comprising:

moving the retention plate toward the main body a first time to cause the bias member to lock into a compressed position, wherein the bias member does not impart an axial force on the retention plate when in the compressed position;

positioning an outward side of the retention plate proximate to an engagement surface; and moving the retention plate toward the main body a second time to cause the bias member to unlock, wherein unlocking the bias member causes the bias member to impart an axial force on the retention plate and cause the retention plate to form a compression engagement with the engagement surface.

2. The method of claim 1, wherein causing the bias member to lock into a compressed position comprises causing a cam to engage with an alignment member disposed within the headrail.

3. The method of claim 2, wherein causing the bias member to unlock comprises causing the cam to disengage with the alignment member.

4. The method of claim 3, wherein the bias member imparts a first axial force on the cam, and wherein causing the cam to disengage with the alignment member comprises imparting a second axial force, opposite the first axial force, on the cam.

5. The method of claim 4, wherein the cam is a first cam and imparting the second axial force on the first cam comprises using a second cam to impart the second axial force on the first cam, wherein the second cam imparts a rotational force on the first cam.

6. The method of claim 1, wherein an end of the headrail comprises the retention plate, the retention plate having a grip surface.

7. The method of claim 6, wherein the grip surface comprises a plurality of protuberances.

8. The method of claim 1, further comprising inserting into an end of the headrail a locking, headrail-retention mechanism comprising the biasing member.

9. A method for positioning and maintaining a headrail in a predetermined position, comprising:

locking a biasing member into a compressed position, wherein locking the biasing member into the compressed position comprises orienting a cam disposed within the headrail in a first position relative to an alignment member, wherein in the first position, the alignment member axially secures the cam so as to prevent the bias member from imparting an axial force on a retention plate coupled with the cam;

positioning an outward side of the retention plate proximate to an engagement surface; and unlocking the biasing member, wherein unlocking the bias member comprises orienting the cam in a second position relative to the alignment member, wherein in the second position, the alignment member permits the cam to move axially so as to permit the bias member to impart an axial force on the retention plate and cause the retention plate to form a compression engagement with the engagement surface.

10. The method of claim 9, wherein locking the bias member into a compressed position comprises causing the cam to engage with the alignment member.

11. The method of claim 10, wherein unlocking the bias member comprises causing the cam to disengage from the alignment member.

12. The method of claim 11, wherein the bias member imparts a first axial force on the cam, and wherein causing the cam to disengage from the alignment member comprises imparting a second axial force, opposite the first axial force, on the cam.

13. The method of claim 12, wherein the cam is a first cam and imparting the second axial force on the first cam comprises using a second cam to impart the second axial force on the first cam, wherein the second cam imparts a rotational force on the first cam.

14. The method of claim 9, wherein an end of the headrail comprises the retention plate, the retention plate having a grip surface.

15. The method of claim 14, wherein the grip surface comprises a plurality of protuberances.

16. The method of claim 9, further comprising inserting into an end of the headrail a locking, headrail-retention mechanism comprising the biasing member.

17. The method of claim 9, wherein locking the biasing member into the compressed position comprises moving the retention plate toward the main body a first time, and wherein unlocking the biasing member comprises moving the retention plate toward the main body a second time.

18. A method for positioning and maintaining a headrail in a predetermined position, comprising:

locking a biasing member into a compressed position, wherein the biasing member imparts an axial force on a cam disposed within the headrail, and wherein locking the biasing member into the compressed position comprises orienting an alignment member disposed within the headrail within a recess of the cam so as to prevent the bias member from imparting an axial force on a retention plate that is axially movable relative to the cam when the biasing member is locked in the compressed position;

positioning an outward side of the retention plate proximate to an engagement surface; and unlocking the biasing member, wherein unlocking the bias member comprises orienting an alignment member disposed within the headrail within a groove of the cam so as to permit the bias member to impart an axial force on the retention plate and cause the retention plate to form a compression engagement with the engagement surface.

19. The method of claim 18, wherein locking the bias member into the compressed position comprises causing the cam to engage with the alignment member.

20. The method of claim 19, wherein unlocking the bias member comprises causing the cam to disengage with the alignment member.

21. The method of claim 20 wherein the bias member imparts a first axial force on the cam, and wherein causing the cam to disengage with the alignment member comprises imparting a second axial force, opposite the first axial force, on the cam.

22. The method of claim 21, wherein the cam is a first cam and imparting the second axial force on the first cam comprises using a second cam to impart the second axial force on the first cam, wherein the second cam imparts a rotational force on the first cam.

23. The method of claim 18, wherein an end of the headrail comprises the retention plate, the retention plate having a grip surface.

24. The method of claim 23, wherein the grip surface comprises a plurality of protuberances.

25. The method of claim 18, further comprising inserting into an end of the headrail a locking, headrail-retention mechanism comprising the biasing member.

26. The method of claim 18, wherein locking the biasing member into the compressed position comprises moving the retention plate toward the main body a first time, and wherein unlocking the biasing member comprises moving the retention plate toward the main body a second time.

* * * * *